US008716958B2

(12) United States Patent
Sierra

(10) Patent No.: US 8,716,958 B2
(45) Date of Patent: May 6, 2014

(54) MICROWAVE DEVICE FOR ACCELERATING ELECTRONS

(75) Inventor: Serge Sierra, Saint Cloud (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 13/391,380

(22) PCT Filed: Aug. 19, 2010

(86) PCT No.: PCT/EP2010/062110

§ 371 (c)(1),
(2), (4) Date: Apr. 12, 2012

(87) PCT Pub. No.: WO2011/020882

PCT Pub. Date: Feb. 24, 2011

(65) Prior Publication Data

US 2012/0200238 A1 Aug. 9, 2012

(30) Foreign Application Priority Data

Aug. 21, 2009 (FR) ..... 09 04023

(51) Int. Cl.
*H05H 9/00* (2006.01)

(52) U.S. Cl.
USPC ..... 315/505; 315/500; 315/501; 315/502; 315/503; 315/506

(58) Field of Classification Search
USPC ..... 315/500–505
See application file for complete search history.

(56) References Cited

U.S. PATENT DOCUMENTS 2,887,580 A 5/1959 Bischoff
4,006,422 A 2/1977 Schriber
4,347,547 A 8/1982 Gibson
4,400,650 A * 8/1983 Giebeler, Jr. ..... 315/5.41
4,485,346 A * 11/1984 Swenson et al. ..... 315/505
4,642,571 A * 2/1987 Minami et al. ..... 327/181

(Continued)

FOREIGN PATENT DOCUMENTS

WO 2004/030162 A2 4/2004

OTHER PUBLICATIONS

Vikulov V. F. et al.: "A Compact Standing-Wave Electron Linac with RF Drive System Using 3 dB Hybrid Junction," IEEE Transactions on Nuclear Science, IEEE Service Center, New York, NY, US, vol. 34, No. 3, Jun. 1, 1979, pp. 4292-4293.

(Continued)

*Primary Examiner* — Douglas W Owens
*Assistant Examiner* — Srinivas Sathiraju
(74) *Attorney, Agent, or Firm* — Baker & Hostetler LLP

(57) ABSTRACT

A microwave device for accelerating electrons includes an electron gun providing an electron beam along an axis in a microwave structure for accelerating the electrons of the beam, an input for the electron beam, an output for accelerated electrons, and a series of coupled cavities along said axis, of central resonant frequency, an input for a microwave signal for excitation of the microwave structure by one of the cavities, a radiofrequency generator providing the excitation microwave signal to the acceleration microwave structure, and a central unit controlling the variation of energy of the electrons at the output of the microwave structure. The radiofrequency generator comprises a frequency control input for changing the frequency of the excitation microwave signal around the central resonant frequency, the change producing a variation of the energy of the accelerated electrons of the beam at the output of the microwave structure.

12 Claims, 5 Drawing Sheets

(56) References Cited

U.S. PATENT DOCUMENTS

| | | | | |
|---|---|---|---|---|
| 5,029,259 | A * | 7/1991 | Nishihara | 315/5.41 |
| 5,381,072 | A * | 1/1995 | Tanabe | 315/5.41 |
| 5,661,377 | A * | 8/1997 | Mishin et al. | 315/505 |
| 5,744,919 | A * | 4/1998 | Mishin et al. | 315/505 |
| 5,811,943 | A * | 9/1998 | Mishin et al. | 315/505 |
| 6,316,876 | B1 * | 11/2001 | Tanabe | 315/5.41 |
| 6,376,990 | B1 * | 4/2002 | Allen et al. | 315/5.41 |
| 6,465,957 | B1 * | 10/2002 | Whitham et al. | 315/5.41 |
| 7,400,094 | B2 * | 7/2008 | Meddaugh | 315/5.41 |
| 7,649,328 | B2 * | 1/2010 | Smirnov et al. | 315/505 |
| 2002/0122531 | A1 | 9/2002 | Whitham | |
| 2004/0108823 | A1 * | 6/2004 | Amaldi et al. | 315/505 |
| 2013/0016814 | A1 * | 1/2013 | Treas et al. | 378/106 |

OTHER PUBLICATIONS

Bigolas J. et al.: "The SW accelerating structure of variable energy electron Linac for medical application," Proceedings of the 2001 Particle Accelerator Conference: Chicago, Illinois, USA, Jun. 18-22, 2001 [Particular Accelerator Conference], IEEE Operations Center, Piscataway, NJ, vol. 4, Jun. 18, 2001, pp. 2790-2792.

Tanabe E. et al.: "Compact multi-energy electron linear accelerators," Nuclear Instruments & Methods in Physics Research, Section -B: Beam Interactions With Materials and Atoms, Elsevier, Amsterdam, NL, vol. B10/11, No. Part 2, Jan. 1, 1985, pp. 871-876.

* cited by examiner

MICROWAVE DEVICE FOR ACCELERATING ELECTRONS

CROSS-REFERENCE TO RELATED APPLICATIONS

This application is a National Stage of International patent application PCT/EP2010/062110, filed on Aug. 19, 2010, which claims priority to foreign French patent application No. FR 0904023, filed on Aug. 21, 2009, the disclosures of which are incorporated by reference in their entirety.

FIELD OF THE INVENTION

The invention relates to a radiofrequency accelerator of electrons for a container inspection device.

BACKGROUND

Systems for inspecting containers such as those transported by truck or by boat use a high-energy photon radiation source.

FIG. 1 shows a perspective view of an exemplary embodiment of a container inspection device 10, of the prior art, towed by a haulage vehicle 12.

The inspection device of FIG. 1 essentially comprises a radiofrequency accelerator of electrons 20 hitting a target 22 which in its turn provides a radiation of high-energy photons 26 vertically sweeping a side of the container 10. The accelerator is excited by a microwave source 28 at a frequency f0.

A detector 30 placed on the other side of the container provided an image of a vertical slice of the content of the container. The displacement of the container 10 by the haulage vehicle 12 in a direction 32 makes it possible to obtain a complete image of the content over the whole length of the container. It is also possible for the detector and the container hauled by the truck to move in relative motion with respect to one another.

Other systems comprise two perpendicular sources of irradiation in one and the same inspection plane and two associated detectors so as to provide a (pseudo) three-dimensional image of the content of the container.

In this type of container inspection system, the radiofrequency accelerator is a linear accelerator or LINAC, for LINear ACcelerator, the trajectory of the electrons is always rectilinear, the electric field for accelerating the electrons is of high frequency.

The high-frequency sources used are almost always klystrons or magnetrons. The electrons are accelerated in the LINAC by appropriately synchronized successive high-frequency pulses. By passing through a series of cavities permeated by an alternating electric field, the beam may attain an energy of a few MeV.

Current systems for inspecting containers make it possible to achieve in the form of a series of energy pulses, either irradiations of photons with constant energy, or irradiations with changes of energy in "packets", that is to say changes of energy over long durations with respect to an energy pulse.

The changes of energy on the linear accelerators of the prior art are based either on inter-section phase shifts, or on mechanical shunts making it possible to short-circuit the accelerator cavities at the end of the section. For a moderate span of energy variation, control of the beam current (or "beam loading") or a moderate radiofrequency (RF) power reduction make it possible to change the energy of the electrons at the output of the LINAC but in a restricted span, typically a factor of two between the minimum energy and the maximum energy.

FIGS. 2*a* and 2*b* represent the energy of the electrons according to two techniques of pulse-based acceleration of the prior art using a radiofrequency accelerator of frequency f0.

FIG. 2*a* shows the energy of the electrons in the form of a series of pulses of width L and of energy E that is constant from one pulse to another during a certain time.

FIG. 2*b* shows the energy of the electrons in the form of successive packets P1, P2 of pulses of like width L. The energy of the pulses of each packet is the same silk E1 for the pulses of the packet P1 and E2 for the pulses of the packet P2.

In a known manner, the energy of the photos which is radiated by the target, expressed in MV, is directly related to the energy of the electrons, expressed in MeV, at the output of the acceleration radiofrequency device impacting said target.

In the prior art system a certain latency time Tr is required in order to go from the pulses of energy E1 to the pulses of energy E2, thereby representing a drawback for the inspection device. This latency time Tr is due, in prior art LINACS with switching, to the time required for mechanically switching the shunts so as to short-circuit certain elements of one of the cavities of the LINAC so as to vary the electric field in the cavities.

In prior art LINACS with two cascaded sections the latency time Tr is due to the time required for the change of phase in the output section by motors controlled by an energy changing device.

In current container inspection systems, it is sought to obtain an ever greater span of variation of the energy radiated so as to increase the precision of the identification of the content of a container.

The current demand leads to the investigation of inspection systems making it possible to achieve irradiations where the energy is changed from one pulse to another.

SUMMARY OF THE INVENTION

To obtain greater precision in identifying the content of a container in container inspection systems, the invention proposes a microwave device for accelerating electrons comprising:

- an electron gun providing an electron beam along an axis ZZ',
- a microwave structure for accelerating the electrons of the beam provided by the electron gun, the microwave structure having, along the axis ZZ', two opposite ends, one of the ends on the electron gun side comprising an input for the electron beam, the other end comprising an output for the accelerated electrons of the beam, between the two ends of the microwave structure, a series of n coupled cavities C1, C2, . . . Ci, . . . Cx, . . . Cn, along said axis ZZ', of central resonant frequency f0, x being the rank of the cavity in the series of n cavities, the microwave structure having, furthermore, an input for a microwave signal Urf for excitation by an input cavity Ci forming part of the series of n cavities,
- a radiofrequency generator controllable in terms of frequency Fv comprising a frequency control input, a microwave output providing the excitation microwave signal Urf at the frequency Fv to the microwave signal input of the microwave structure,
- a central unit UC providing a signal for controlling the frequency Fv to the frequency control input of the radiofrequency generator, the input cavity Ci being a cavity close to the end of the microwave structure on the electron gun side, the central unit UC is configured to control at least the frequency Fv of the radiofrequency generator around the central resonant frequency f0 so as to provide at the output of the microwave structure a series of pulses I1, I2, I3, . . . Iy, . . . of accelerated electrons of respective energy levels E1, E2, E3, . . . Ey, . . . varying from one pulse Iy to the next I(y+1), y being the rank of the pulse in the series of pulses, a frequency Fvy of the excitation signal Urf during a pulse Iy producing an energy Ey of the accelerated electrons at the output of the microwave structure Advantageously the radiofrequency generator comprises a klystron operating as microwave amplifier and a local oscillator OL, the microwave input of the klystron being driven by a microwave output of the local oscillator comprising the frequency control input for the excitation microwave signal Ufr, the power output of the klystron being applied to the excitation microwave signal input of the microwave structure.

In one embodiment, the electron gun comprises a grid for controlling the current of the electron beam.

In another embodiment, the central unit UC comprises a control output providing the grid of the gun with a voltage Uc for controlling the current of the electron beam.

In another embodiment, the radiofrequency generator comprises an input for controlling the level of the excitation microwave signal Urf driven by the central unit UC.

In another embodiment, the input cavity Ci close to the end of the microwave structure on the electron gun side is a cavity chosen between the first cavity C1, i.e. x=1, and a cavity Ci of order x=n/3.

In another embodiment, the excitation signal Urf is applied to the third cavity of the series of n coupled cavities C1, C2, . . . Ci, . . . Cx, . . . Cn, the first cavity of the series being the one closest to the electron gun.

In another embodiment, the microwave structure for accelerating electrons comprises 40 to 50 cavities, i.e. n lying between 40 and 50, operating at a central frequency of 3 GHz, the variation of the central frequency f0 of the radiofrequency generator driving the microwave structure being of the order of 1 MHz, the frequency Fv varying between Fv=fo+ or −500 KHz, so as to obtain the maximum variations of the energy E1, E2, E3, . . . Ey, . . . of the respective pulses I1, I2, I3, . . . Iy . . . lying between 3 and 25 MeV.

In another embodiment, the duration L of a pulse Iy lies between 3 and 4 microseconds.

The invention is applicable to a container inspection device comprising a microwave device for accelerating electrons according to the invention.

The invention also relates to a method for the implementation of a microwave device for accelerating electrons comprising:

an electron gun providing an electron beam along an axis ZZ', a microwave structure for accelerating the electrons of the beam provided by the electron gun, the microwave structure having, along the axis ZZ', two opposite ends, one of the ends on the electron gun side comprising an input for the electron beam, the other end comprising an output for the accelerated electrons of the beam, between the two ends of the microwave structure, a series of n coupled cavities C1, C2, . . . Ci, . . . Cx, . . . Cn, along said axis ZZ', of central resonant frequency f0, x being the rank of the cavity in the series of n cavities, the microwave structure having, furthermore, an input for a microwave signal Urf for excitation by an input cavity Ci forming part of the series of n cavities, a radiofrequency generator controllable in terms of frequency Fv comprising a frequency control input, a microwave output providing the excitation microwave signal Urf at the frequency Fv to the microwave signal input (74) of the microwave structure, a central unit UC providing a signal for controlling the frequency Fv to the frequency control input of the radiofrequency generator, characterized in that, the input cavity Ci being a cavity close to the end of the microwave structure on the electron gun side, it consists at least in changing the frequency Fv of the radiofrequency generator around the central resonant frequency f0 so as to provide at the output of the microwave structure a series of pulses I1, I2, I3, . . . Iy, . . . of accelerated electrons of respective energy levels E1, E2, E3, . . . Ey, . . . varying from one pulse Iy to the next I(y+1), y being the rank of the pulse in the series of pulses, a frequency Fvy of the excitation signal Urf during a pulse Iy producing an energy Ey of the accelerated electrons at the output of the microwave structure.

In one embodiment, the electron gun comprising a grid for controlling the current of the electron beam, the method consists moreover in controlling the current of the electron beam so as to control the electrons at the output of the microwave structure.

The original solution proposed by the invention makes it possible to obtain variations of the energy at the output of the linear accelerator in much bigger proportions than those obtained by the electron acceleration devices of the prior art. This proposed solution consists in varying the real RF working frequency of the accelerator, optionally allied with the other energy control parameters such as the level of the beam current and the RF power in the LINAC.

The variation of energy by varying the frequency of the RF signal injected into the LINAC is taken into account right from the design of the accelerator section so as to allow its optimization.

Accordingly the RF input must be dissymmetric over the section of the cavities on the gun side. For standing waves, the effect is accentuated, thus by varying the frequency with respect to the central frequency f0, a wide range of energies may be obtained (typically a factor of 8 is obtained in certain medical accelerators).

Consequently by allying this principle of varying the frequency of the accelerator with an RF source allowing a change of frequency from pulse to pulse (typically a klystron in which the working frequency is changed by means of its RF drive) it is possible to obtain an interleaving of modes in terms of energy covering a vast range of energies.

Moreover if this system is associated with an electron gun whose emission may be modified from pulse to pulse, the possibility of varying the energy and dose (or conversely of maintaining the latter) for each energy pulse is then obtained.

BRIEF DESCRIPTION OF THE DRAWINGS

The invention will be better understood with the aid of an exemplary embodiment of an acceleration microwave device according to the invention, with reference to the indexed drawings in which.

DETAILED DESCRIPTION

Figure 1:
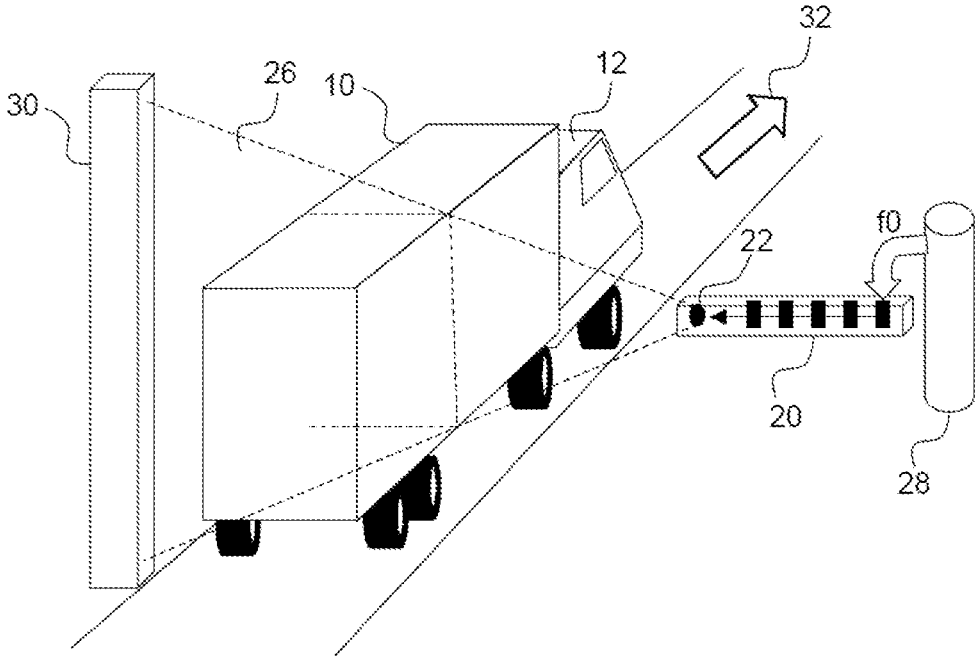
FIG.1 (PRIOR ART)
FIG. 1, already described, shows a perspective view of an exemplary embodiment of a container inspection device, of the prior art.
Figure 2A:
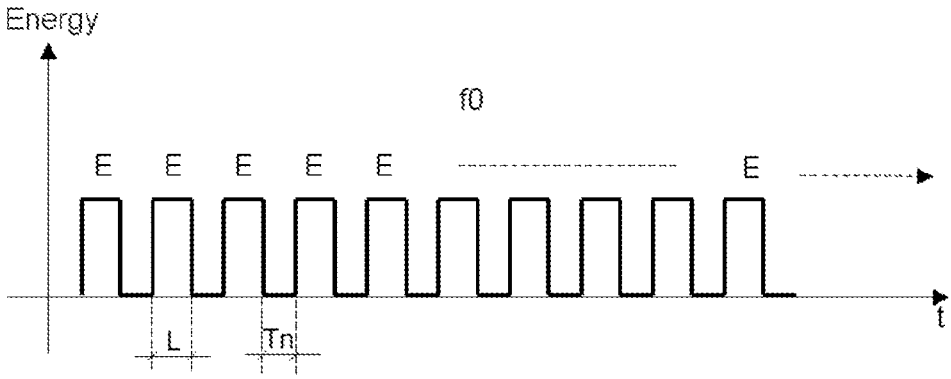
FIG.2a (PRIOR ART)
FIGS. 2*a* and 2*b*, already described, represent the energy irradiated according to two techniques of pulse-based irradiation of the prior art.
Figure 2B:
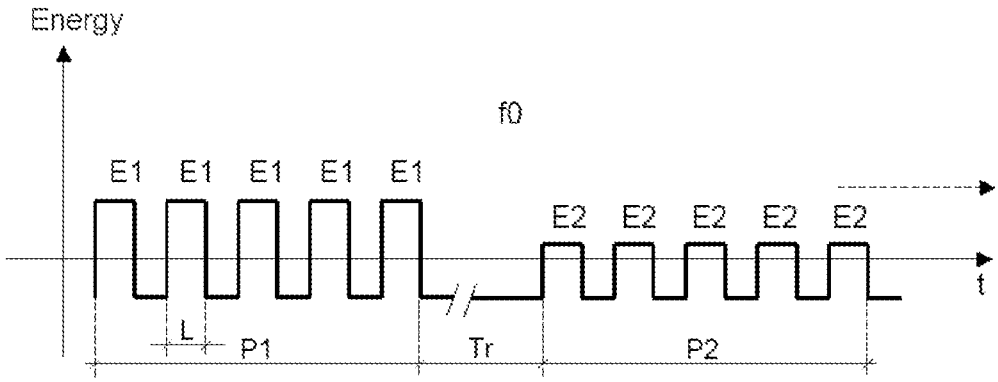
FIG.2b (PRIOR ART)
Figure 3A:
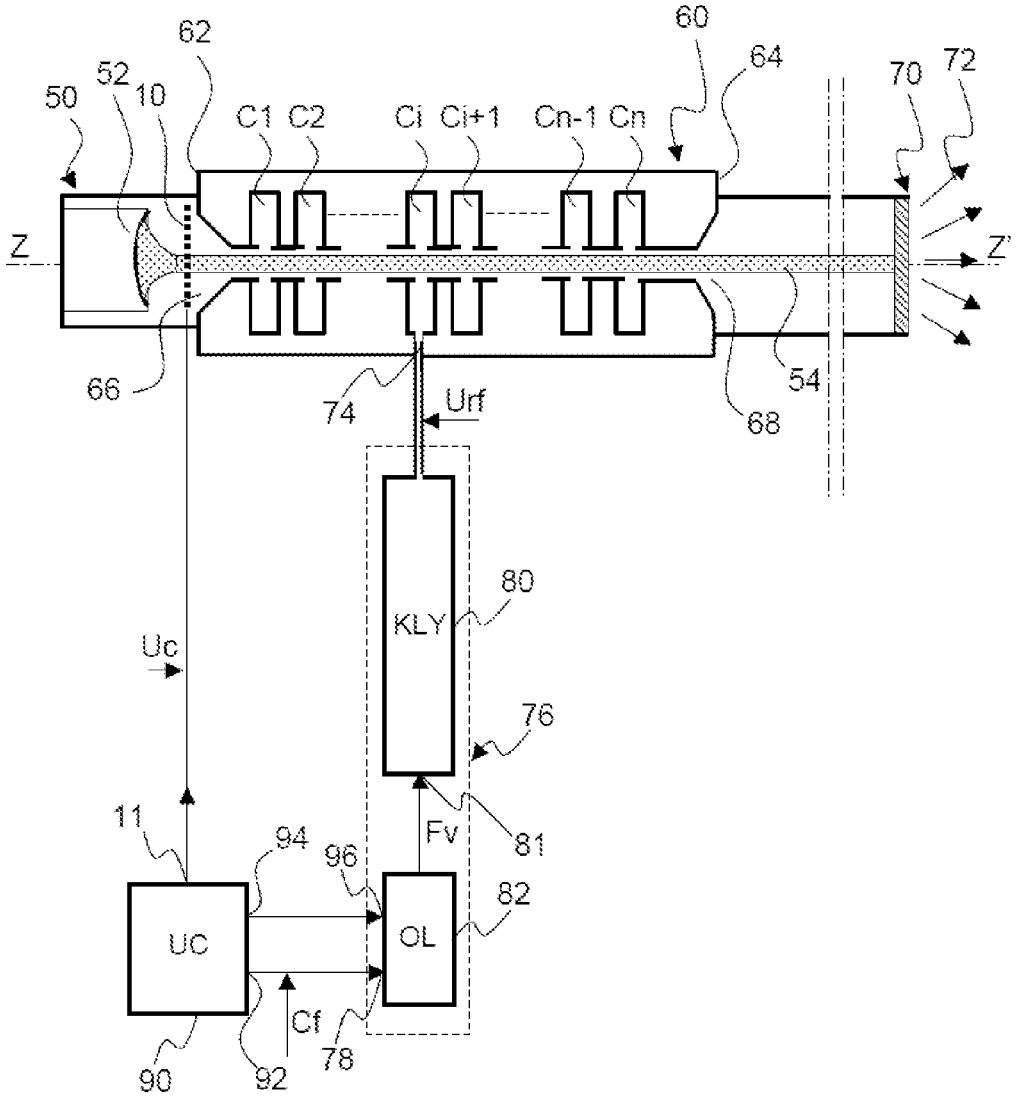
FIG. 3*a* represents an exemplary embodiment of a radiofrequency electron acceleration device according to the invention.

FIG. 3*a* represents an exemplary embodiment of a radiofrequency electron acceleration device according to the invention.

The device of FIG. 3*a* essentially comprises an electron gun 50 having a cathode 52 providing an electron beam 54 in an evacuated microwave structure 60, of klystron type, forming a linear radiofrequency accelerator of electrons (accelerator section), along a longitudinal axis ZZ'.

The microwave structure 60, of longitudinal form along the axis ZZ', comprises two opposite ends 62, 64 and between its two ends a series of n cavities C1, C2, . . . Ci, . . . Cx, . . . Cn, aligned along the longitudinal axis ZZ' forming a LINAC, x being the rank of the cavity in the series of n cavities. A cavity Cx of the series is coupled to the previous Cx−1 and to the next Cx+1. The cavities exhibit a resonant frequency f0.

One of the ends 62 of the microwave structure comprises, on the side of a first cavity C1 of the series of n cavities, an input 66 for the electron beam 54 emitted by the electron gun 50. The other end 64, on the side of a last cavity Cn of said series, comprises an output 68 for accelerated electrons of the beam.

The accelerated electrons output by the LINAC are intended to hit a target 70 providing photons 72 at high energy for the irradiation of the container to be inspected.

The microwave structure 60 comprises a radiofrequency input 74 for excitation, at the level of one of the cavities Ci of the series of n cavities, close to the electron beam input 66.

The cavity close to the end 62 of the microwave structure on the electron gun side and by which a radiofrequency excitation signal is applied is an input cavity Ci chosen between the first cavity C1, i.e. x=1, and a cavity Ci of order x=n/3. The input cavity Ci is therefore a cavity of the first third of the series of n cavities on the electron gun side.

For example, the radiofrequency excitation input 74 may be embodied by the third cavity C3 (x=3) in a structure comprising 40 to 50 cavities.

In a known manner the electron beam 54 is focused on the axis ZZ' of the microwave structure by a device of permanent magnets or solenoids, not represented in the figure, surrounding said structure. The electron beam 54 may also be autofocused by the RF itself.

In this exemplary embodiment of FIG. 3*a*, the acceleration device comprises a microwave klystron KLY 80 operating as microwave amplifier driven by an RF input 81 by the RF output of a local oscillator OL 82 of central frequency f0 that may be controlled in terms of frequency Fv around this central frequency f0. For this purpose, the local oscillator OL comprises a frequency control input 78 for varying its central frequency f0.

The klystron 80 provides, at an RF output, according to a main characteristic of the invention, a microwave signal Urf for excitation of the input cavity Ci close to the input 66 for the electron beam at the excitation frequency Fv.

The energy of the electrons at the output of the microwave structure may be changed within a large span of energies through the variation of frequency Fv at the output of the RF generator 76.

Figure 3B:
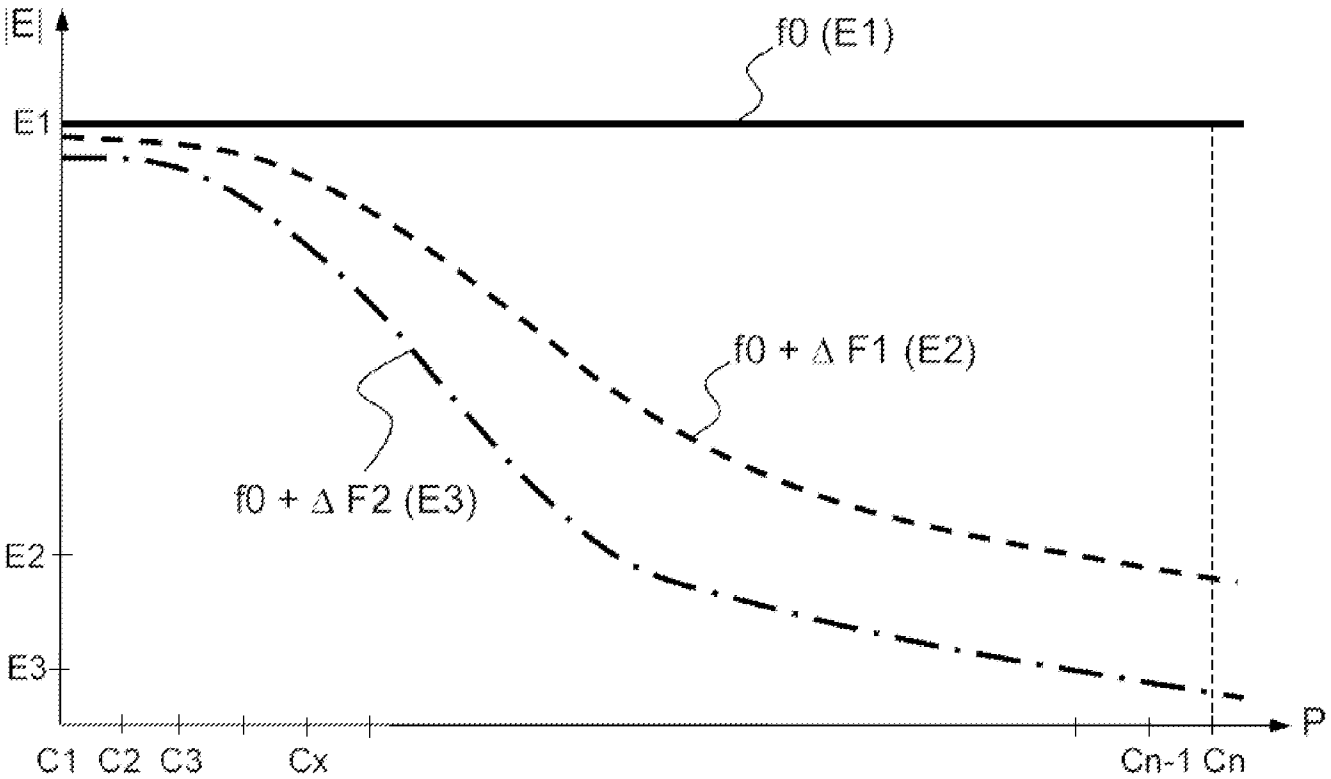
FIG. 3*b* shows a graphic representing the variation of the field for accelerating the electrons along the microwave structure of the acceleration device of FIG. 3*a;*

FIG. 3*b* shows a graphic representing the variation of the field for accelerating the electrons along the microwave structure of the acceleration device of FIG. 3*a*.

The graphic of FIG. 3*b* comprises, as ordinate, the value of the envelope of the acceleration field and, as abscissa, the positon P considered along the microwave structure 60 of the electron accelerator. This position P is tagged by the position of the cavity in the microwave structure varying from the first cavity C1 to the last cavity Cn.

The graphic of FIG. 3*b* shows three curves corresponding to the variations of the acceleration field E along the microwave structure for the central frequency f0 and for two deviations around the central frequency f0 at the output of the klystron 80 driving the input cavity Ci.

The acceleration field is a maximum in proximity to the input 66 of the microwave structure.

For a frequency at the output of the klystron 80 equal to the central frequency f0, the envelope of the field as a function of the position P is substantially constant along the microwave structure. The energy of the electrons at the output 68 of the structure is therefore a maximum (E1).

For a frequency of the klystron deviating by a first value Δf1 from the central frequency f0, i.e. Fv1=f0+Δf1, the envelope of the field as a function of the position P decreases, the energy of the electrons at the output 68 of the microwave structure is then E2 less than E1.

For a frequency of the klystron deviating by a second value Δf2 larger than Δf1 from the central frequency f0, i.e. Fv2=f0+Δf2, the envelope of the field as a function of the position P decreases more rapidly than in the previous case, the energy of the electrons at the output of the structure is then E3 less than E2.

The electron acceleration device according to the invention makes it possible to obtain a dynamic swing (E1 to E3) of energy variations at the output of the microwave structure, by variation of the central frequency f0, of the order typically of 3 to 25 MeV for a variation in frequency of the order of a Mhz.

The microwave device for accelerating electrons comprises, furthermore, a central unit UC 90 configured to control the energy variation of the electrons at the output of the microwave structure.

Figure 4:
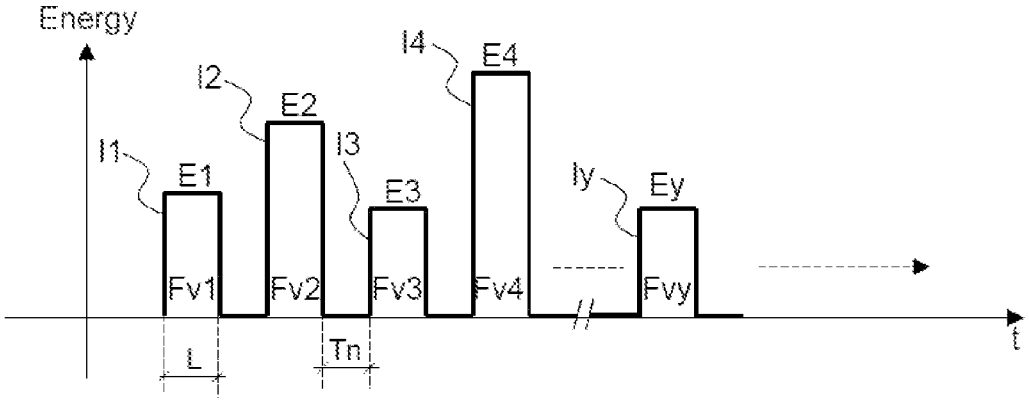
FIG. 4 represented the energy of the electrons at the output of the microwave device of FIG. 3*a*.

FIG. 4 represented the energy of the electrons at the output of the microwave device of FIG. 3*a*.

In this exemplary embodiment, the energy of the electrons at the output of the microwave structure 60 is in the form of a pulse series I1, I2, I3, . . . Iy . . . of respective energy E1, E2, E3, . . . Ey . . . For this purpose, the frequency of the radiofrequency generator is controlled by the central unit UC so as to change the frequency Fv in synchronism with said energy pulses I1, I2, I3, . . . Iy . . . .

The accelerated electrons of the beam at the output 68 of the microwave structure hit the target 70 with an impulse energy that varies as a function of the frequency Fv of the microwave signal applies by the klystron to the structure. In its turn the target irradiates photons 72 of energy dependent on the energy of the incident electrons.

FIG. 4 shows the energy E1, E2, E3, . . . Ey . . . of the electrons impacting the target 70 for each respective energy pulse I1, I2, I3, . . . Iy . . . at the output of the microwave structure as a function of time t.

The energy of the electrons E1, E2, E3, . . . Ey . . . may be controlled to a desired value for each of the successive pulses I1, I2, I3, . . . Iy . . . by changing the frequency Fv of the local oscillator at each pulse.

The frequency of the local oscillator OL 82 is controlled by the central unit UC so as to change the frequency Fv in synchronism with said energy pulses, a frequency Fvy of the local oscillator and therefore of the excitation microwave signal provides by the klystron producing an energy Ey of the respective pulse Iy at the output of the acceleration microwave structure. For this purpose, the central unit UC comprises a control output 92 providing a control signal Cf of frequency Fv at the frequency control input 78 of the local oscillator OL 82.

Two consecutive energy pulses Iy, I(y+1) are separated by a time period Tn with zero energy obtained, either by actions of interrupting the beam current, or by interrupting the RF excitation of the klystron KLY or by both actions.

The interruption of the RF excitation is controlled by the central unit UC. For this purpose, the central unit UC it comprises a control output 94 driving an input 96 of the local oscillator LO so as to interrupt the RF level driving the klystron and consequently the level of the excitation microwave signal Urf.

In an exemplary embodiment of the acceleration device according to the invention, the acceleration microwave structure comprises 40 to 50 cavities (n lying between 40 and 50) operating at a central frequency of 3 GHz. The variation of the central frequency f0 of the radiofrequency generator driving the microwave structure (LINAC) is of the order of 1 MHz, i.e. Fv=f0+ or −500 KHz, so as to obtain the maximum variations of the energy of the pulses and possibly lying between 3 and 25 MeV.

The duration L of a pulse is of the order of 3 to 4 microseconds.

The excitation of the LINAC is performed by the third cavity C3.

Figure 5:
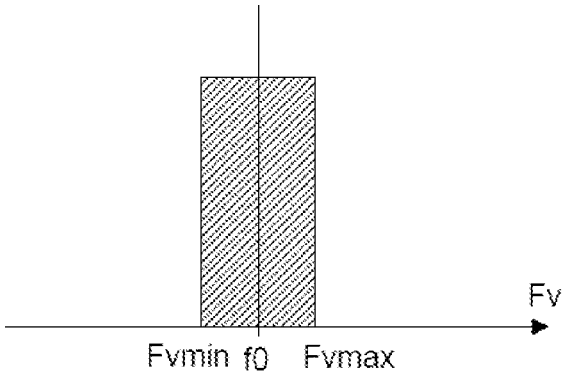
FIG. 5 shows the span of variation of frequency Fv of the excitation signal of the device of FIG. 3*a*.

FIG. 5 shows the span of variation of frequency Fv of the excitation signal of the device of FIG. 3*a* around the central frequency f0 between a maximum frequency Fvmax and a minimum frequency Fvmin.

In other embodiments, the radiofrequency generator 76 may be a magnetron controlled in terms of frequencies by the central unit UC.

The electron acceleration device according to the invention makes it possible to change the energy of the electrons, and therefore the energy irradiated by the target, from one pulse to the next with very great rapidity much faster than that of the devices with mechanical switching of the prior art, therefore without latency time Tr.

In a variant embodiment of the device according to the invention, the electron gun comprises a grid 10 for controlling the current of the electron beam. The central unit UC comprises a control output 11 providing the grid 10 with a control voltage Uc for said beam current.

Control of the beam current makes it possible to adapt, by controlling the electrons sent to the target 70 on output from the microwave structure, the radiation dose (expressed in Joules/kilogram) of photons emitted by said target, regardless of the energy level of the electrons striking the target.

Control of the beam current makes it possible, for example, to maintain a constant radiation dose regardless of the energy level of the electrons during the pulses.

In the case of a device for inspecting containers the use of such an acceleration device according to the invention with energy varying very rapidly and in significant and intertwined proportions allows finer detection with greater resolution of the details of the content of the container. Furthermore, it allows a wide spectrum of analysis of the irradiated elements with the possibility of detecting the family of materials defined by their atomic number.

The device is not limiting to the industrial application of container inspection, it may also be used in the medical domain and notably in radiotherapy.

The invention claimed is:

1. A microwave device for accelerating electrons, comprising:

an electron gun providing an electron beam along an axis ZZ', a microwave structure for accelerating the electrons of the beam provided by the electron gun, the microwave structure having, along the axis ZZ', two opposite ends, one of the ends on the electron gun side comprising an input for the electron beam, the other end comprising an output for the accelerated electrons of the beam, between the two ends of the microwave structure, a series of n coupled cavities C1, C2, . . . Ci, . . . Cx, . . . Cn, along said axis ZZ', of central resonant frequency f0, x being a rank of the cavity in the series of n coupled cavities, the microwave structure having an input for a microwave signal Urf for excitation by an input cavity Ci forming part of the series of n coupled cavities, a radiofrequency generator controllable in terms of a frequency Fv comprising a frequency control input, a microwave output providing the excitation microwave signal Urf at the frequency Fv to the microwave signal input of the microwave structure, a central unit UC providing a signal for controlling the frequency Fv to the frequency control input of the radiofrequency generator, the input cavity Ci being a cavity closer to the end of the microwave structure on the electron gun side than to the other end of the microwave structure comprising the output for the accelerated electrons, the central unit UC is configured to control at least the frequency Fv of the radiofrequency generator around the central resonant frequency f0 so as to provide at the output of the microwave structure a series of pulses I1, I2, I3, . . . Iy, . . . of accelerated electrons of respective energy levels E1, E2, E3, . . . Ey, . . . varying from one pulse Iy to the next I(y+1), y being the rank of the pulse in the series of pulses, a frequency Fvy of the excitation signal Urf during a pulse Iy producing an energy Ey of the accelerated electrons at the output of the microwave structure.

2. The microwave device as claimed in claim 1, wherein the radiofrequency generator comprises a klystron operating as microwave amplifier and a local oscillator OL, the microwave input of the klystron being driven by a microwave output of the local oscillator comprising the frequency control input for the excitation microwave signal Ufr, the power output of the klystron being applied to the excitation microwave signal input of the microwave structure.

3. The microwave device as claimed in claim 1, wherein the electron gun comprises a grid for controlling the current of the electron beam.

4. The microwave device as claimed in claim 3, wherein the central unit UC comprises a control output providing the grid of the gun with a voltage Uc for controlling the current of the electron beam.

5. The microwave device as claimed in claim 1, wherein the radiofrequency generator comprises an input for controlling the level of the excitation microwave signal Urf driven by the central unit UC.

6. The microwave device as claimed in claim 1, wherein the input cavity Ci close to the end of the microwave structure on the electron gun side is a cavity chosen between the first cavity C1, with x=1, and a cavity Ci of order x=n/3.

7. The microwave device as claimed in claim 1, wherein the excitation signal Urf is applied to the third cavity (C3) of the series of n coupled cavities C1, C2, . . . Ci, . . . Cx, . . . Cn, the first cavity (C1) of the series being the one closest to the electron gun.

8. The microwave device as claimed in claim 1, wherein the microwave structure for accelerating electrons comprises 40 to 50 cavities, with n lying between 40 and 50, operating at a central frequency of 3 GHz, the variation of the central frequency f0 of the radiofrequency generator driving the microwave structure being of the order of 1 MHz, the frequency Fv varying between Fv=fo+ or −500 KHz to obtain the maximum variations of the energy E1, E2, E3, . . . Ey, . . . , of the respective pulses I1, I2, I3, . . . , Iy, . . . , lying between 3 and 25 MeV.

9. The microwave device as claimed in claim 1, wherein the duration L of a pulse Iy lies between 3 and 4 microseconds.

10. A container inspection device, further comprising a microwave device for accelerating electrons as claimed in claim 1.

11. A method for the implementation of a microwave device for accelerating electrons, the method comprising:

providing, using an electron gun of the microwave device, an electron beam along an axis ZZ', accelerating, at a microwave structure of the microwave device, the electrons of the beam provided by the electron gun, the microwave structure having, along the axis ZZ', two opposite ends, one of the ends on the electron gun side comprising an input for the electron beam, the other end comprising an output for the accelerated electrons of the beam, between the two ends of the microwave structure, a series of n coupled cavities C1, C2, . . . Ci, . . . Cx, . . . Cn, along said axis ZZ', of central resonant frequency f0, x being a rank of the cavity in the series of n coupled cavities, the microwave structure having, furthermore, an input for a microwave signal Uri for excitation by an input cavity Ci forming part of the series of n coupled cavities, controlling a radiofrequency generator of the microwave device in terms of a frequency Fv comprising a frequency control input, a microwave output providing the excitation microwave signal Urf at the frequency Fv to the microwave signal input of the microwave structure, providing, using a central unit UC of the microwave device, a signal for controlling the frequency Fv to the frequency control input of the radiofrequency generator, wherein, the input cavity Ci being a cavity closer to the end of the microwave structure on the electron gun side than to the other end of the microwave structure comprising the output for the accelerated electrons, the central unit UC is at least configured to change the frequency Fv of the radiofrequency generator around the central resonant frequency f0 so as to provide at the output of the microwave structure a series of pulses I1, I2, I3, . . . Iy, . . . of accelerated electrons of respective energy levels E1, E2, E3, . . . Ey, . . . varying from one pulse Iy to the next I(y+1), y being the rank of the pulse in the series of pulses, a frequency Fvy of the excitation signal Urf during a pulse Iy producing an energy Ey of the accelerated electrons at the output of the microwave structure.

12. The method for the implementation of a microwave device for accelerating electrons as claimed in claim 11, the electron gun comprising a grid for controlling the current of the electron beam to control the electrons at the output of the microwave structure.

* * * * *